United States Patent [19]

Corna et al.

[11] 4,380,837

[45] Apr. 26, 1983

[54] METHOD AND APPARATUS FOR CONTROLLING THE FLOW IN SWIMMING POOL GUTTERS

[75] Inventors: John F. Corna, Columbus; Marcel H. Blais, Westerville, both of Ohio

[73] Assignee: Statewide Pools, Inc., Columbus, Ohio

[21] Appl. No.: 249,747

[22] Filed: Apr. 1, 1981

[51] Int. Cl.[3] ..... E04H 3/16; E04H 3/18

[52] U.S. Cl. ..... 4/510; 4/506; 4/507; 4/512

[58] Field of Search ..... 4/510, 506, 512, 513, 4/496, 507; 137/409, 426

[56] References Cited

U.S. PATENT DOCUMENTS

| | | | |
|---|---|---|---|
| 3,432,867 | 3/1969 | Whitten, Jr. | 4/510 |
| 3,815,160 | 6/1974 | Baker | 4/510 |
| 3,908,207 | 9/1975 | van den Broek | 4/510 X |
| 3,945,061 | 3/1976 | Whitten, Jr. | 4/510 |
| 3,968,527 | 7/1976 | Hough | 4/510 |
| 4,050,104 | 9/1977 | Baker | 4/510 |
| 4,173,799 | 11/1979 | Patterson | 4/510 |
| 4,253,202 | 3/1981 | Norris | 4/512 |

FOREIGN PATENT DOCUMENTS

| | | | |
|---|---|---|---|
| 1045706 | 10/1966 | United Kingdom | 4/510 |

*Primary Examiner*—Henry K. Artis

[57] ABSTRACT

A method for establishing a flow gradient along the gutter of a swimming pool of the type that includes a recirculating system for the pool water with said gutter comprising a portion of such system. The method comprises providing a plurality of gutter flow controllers at spaced locations around the perimeter of the pool. Each of such controllers includes an adjustable hydrastatic gate, the operation of which is responsive to the bias of an adjustable spring means. The gutter flow controllers are selectively adjusted to establish the desired flow gradient along the gutter.

4 Claims, 4 Drawing Figures

METHOD AND APPARATUS FOR CONTROLLING THE FLOW IN SWIMMING POOL GUTTERS

BACKGROUND OF THE INVENTION

This invention relates to swimming pools of the type that includes a gutter extending around the periphery of the pool, and more particularly to a novel method for establishing a gradient for the return flow of water to the pools recirculating system.

PROBLEMS IN THE ART

It is the present practice in the art to fabricate swimming pools, and particularly the larger commercial types, from stainless steel sheet metal sections, with such sections forming the pool wall face, as well as the supply conduit and return gutter for the recirculating system. Such pool wall constructions have been provided with various types of skimmer apparatus for the purpose of controlling the level of the flow of return water in the gutters, but in such prior constructions the skimmer apparatus have been permanently built into the pool walls during construction, at various positions around the periphery of the pool, such that the locations of the skimmers are fixed and cannot thereafter be moved to meet the particular requirements which are actually encountered during operation of the swimming pool.

At this point it should be mentioned that for efficient sanitary operation of the gutter system the flow must be established and maintained throughout the peripheral extent of the gutter system to a single gutter system outlet conduit through which the return flow is delivered to the filtering system. Hence it will be understood, that it is most important to be able to selectively locate and individually adjust each skimmer apparatus at a location around the periphery of the pool wherein a skimmer is required to admit more or less pool water, as may be required to establish the proper flow rate and flow gradient along the gutter system.

It should also be mentioned that environmental conditions actually encountered during operation of the swimming pool, such as the direction of the prevailing wind, may dictate the required location and individual adjustment of the skimmers, and moreover, these required locations may from time to time change with seasonal variations in the environment.

In the prior applications of skimmers various arrangements have been used in the attempt to control the flow of water through the skimmer inlet openings. For example various types of floats have been installed in positions wherein the floats are responsive to the level of the water in the gutter. Such float applications have presented problems in that they are eratically responsive to various surge conditions that occur, and moreover are inherently ineffective in that such float applications have not provided any practical means for adjustment to establish a predetermined flow gradient along the gutter. In instances where attempts have been made to adjust floats, in attempts to control the flow of water to the gutter, the control range between open and closed positions with respect to water level variations in the gutter, has been found to be so limited that gradient establishment is precluded.

Another problem has been encountered in use of floats to control the flow of water from the pool to the gutter in that the operation of such floats is inherently responsive to variations in the flow velocity of the water flowing in the gutter.

Another primary purpose for the application of skimmers to swimming pools is to maintain the gutters partially empty to provide reservoir capacity for receiving surge flows of water from the pool, which occur when a group of swimmers simultaneously enter the pool. In the above mentioned prior applications of floats, problems have been encountered under these dynamic surge conditions.

More specifically, due to the above mentioned limited control range of floats in opening and closing the skimmer openings, with respect to variations in water level in the gutter, has been found to be so limited as to preclude the effective maintenance of gutter surge capacity under variations in operation of the pool.

SUMMARY OF THE INVENTION

In general, the present invention comprises a novel method for establishing a predetermined flow gradient along a swimming pool gutter, as may be required by the particular design and operational requirements of the pool.

More particularly, the present method comprises, the installation of a plurality of gutter flow controllers at spaced locations around the perimeter of the pool. Each of theses controllers includes an adjustable hydrostatic gate, which is effective at its respective location, in establishing a predetermined volumetric flow rate from the pool to the gutter. In accordance with the present method, each of the gutter flow controllers is selectively adjusted to provide the proper water depth required to establish the above described predetermined flow gradient.

As another aspect of the present invention a novel method is provided for controlling the surge flows of water from the pool to the gutter. This is effectively accomplished by the above mentioned flow controllers wherein the hydrostatic gates are adapted to produce a throttling effect on the flows from the outlets of the flow controllers responsive to the occurance of surge flows to the gutter and the gates. This results in the maintenance of reservoir capacity in the gutter and hence the effective control of the surge flows.

As still another aspect of the present invention a novel method is provided for controlling the flows of water from a pool to a gutter with the control being automatically effected over a large range of variations in flow conditions.

As another aspect of the present invention, the present method is uniquely effective in providing a large range of adjustment in establishing a predetermined flow gradient along a swimming pool gutter.

As another aspect of the present invention, the present method is uniquely adapted to effectively maintain a predetermined gradient along a swimming pool gutter over a large range of variations in operating conditions.

As still another aspect of the present invention a novel gutter flow controller apparatus is provided which controller is constructed as a unitary self contained module. Hence, the controller can be removeably installed in standardized holes provided in the pool wall construction. As a result the controllers can be selectively located and removed to meet the particular conditions encountered in operation of the pool.

Further objects and advantages of the present invention will be apparent from the following description, reference being had to the accompanying drawings wherein preferred forms of embodiments of the invention are clearly shown.

DESCRIPTION OF THE PREFERRED EMBODIMENT

Figure 1:
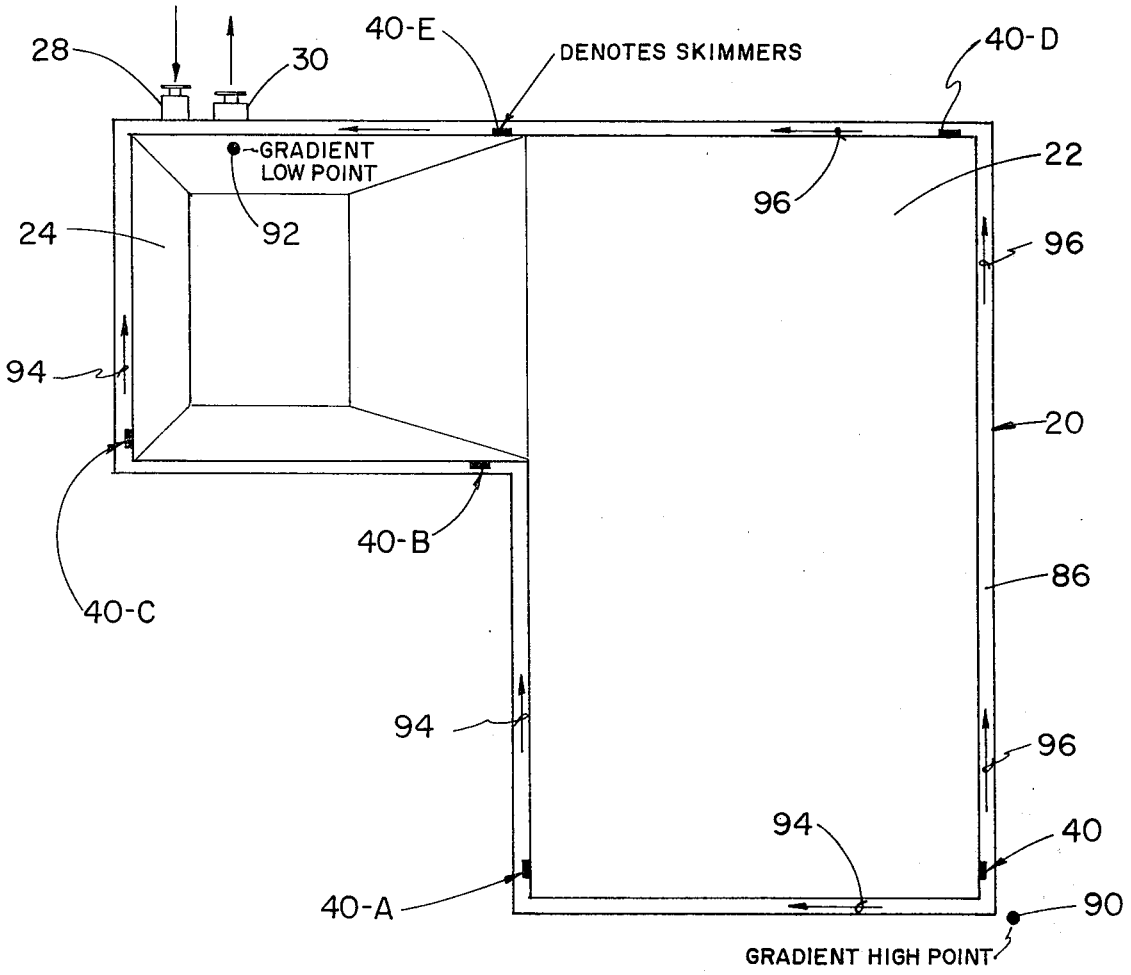
FIG. 1 is a diagrammatic view showing the top elevation of a swimming pool constructed in accordance with the method of the present invention.
Figure 3:
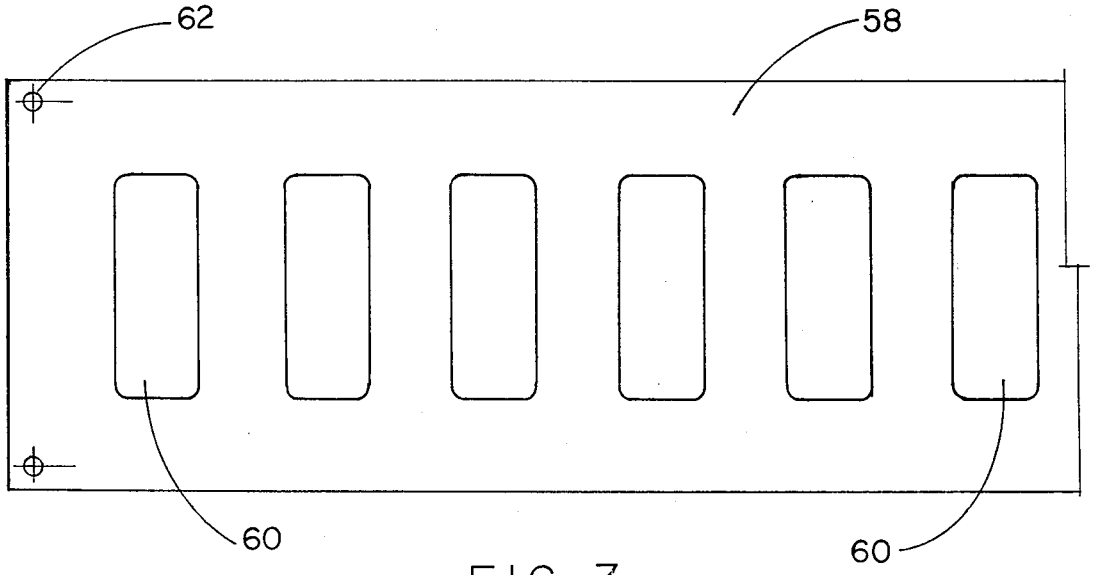
FIG. 3 is a partial front elevational view of the gutter flow controller of FIG. 2.

Referring in detail to the drawings, FIG. 1 illustrates a swimming pool of the type that includes a stainless steel gutter system generally indicated at 20 which extends around the perimeter of a swimming pool area 22 and a diving area 24.

Figure 2:
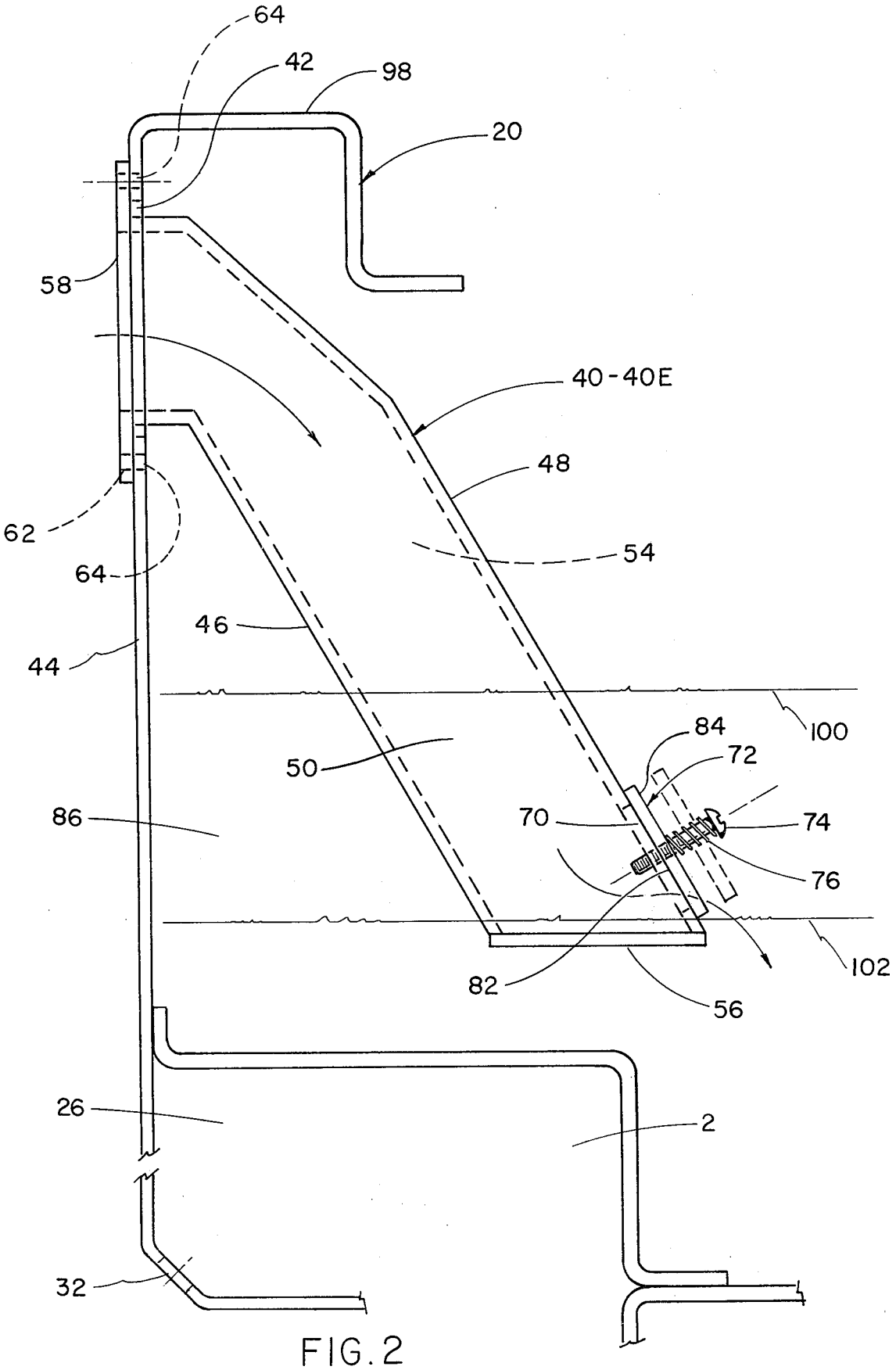
FIG. 2 is a side elevational view, patially in section of a gutter flow controller used in operating the pool of FIG. 1, the section being taken along the line 2—2 of FIG. 1.

The gutter system 20 is shown in detail in FIG. 2 and includes a water delivery conduit 26 that receives filtered water from a conventional recirculating system, not illustrated via an inlet box for the gutter system indicated at 28 in FIG. 1. Water is continuously returned to the recirculating system where it is filtered via a gutter drop or outlet indicated at 30 in FIG. 1.

With continued reference to FIG. 2 a filtered flow of water is continuously delivered to the pool from a delivery conduit 26 via a plurality of delivery conduit outlets 32, which outlets are located at spaced intervals around the perimeter of the pool.

Water from the pool is continuously returned to the FIG. 1 gutter system via a plurality of gutter flow controllers, indicated generally at 40 thru 40-E, which controllers are each removeably mounted in a respective one of a plurality of openings 42 provided in an inner wall 44 of the gutter, as seen in FIG. 2.

Figure 4:
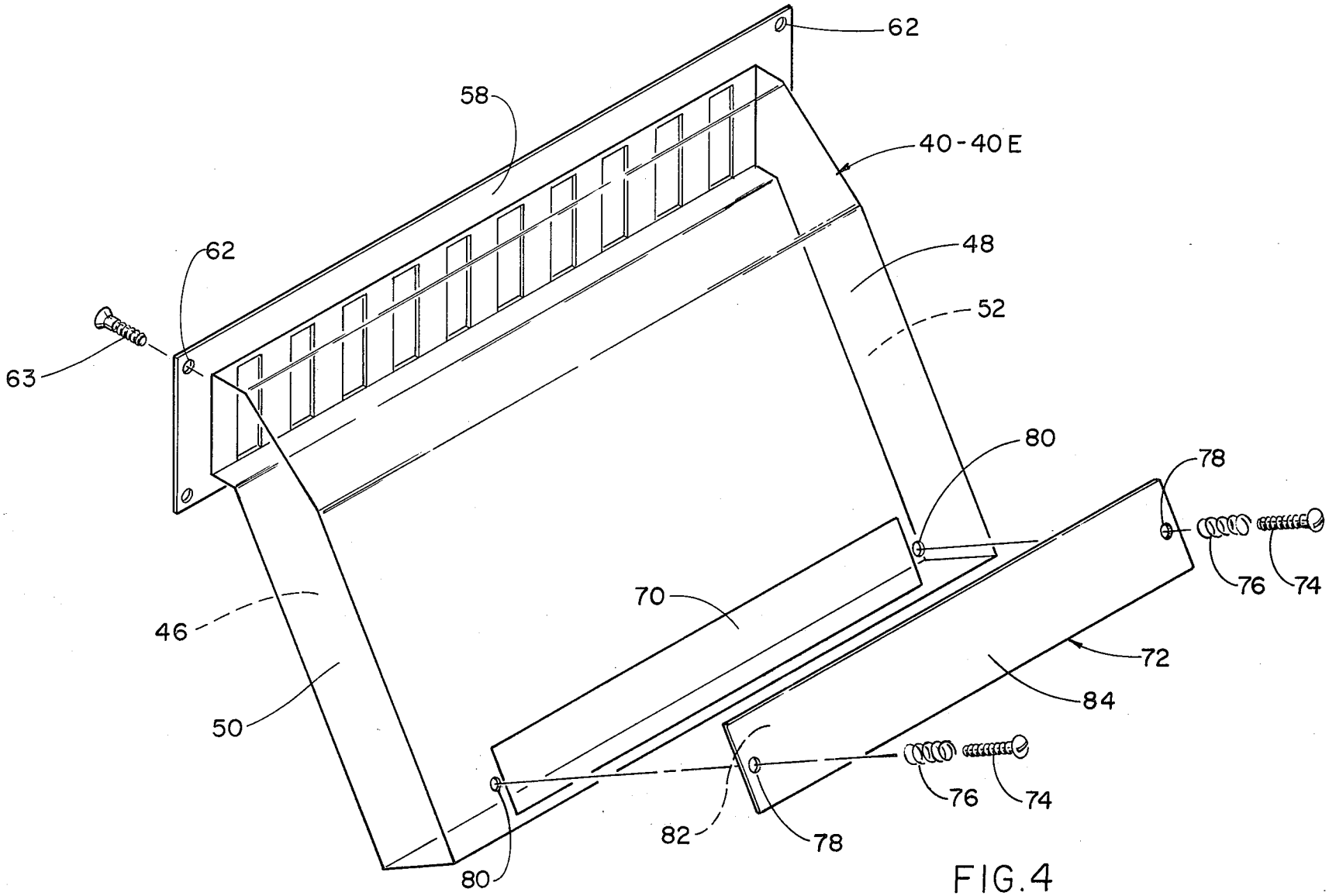
FIG. 4 is an exploded perspective view of the gutter flow controller of FIGS. 2 and 3.

Referring to FIGS. 2 and 4 each of the gutter flow controllers 40 through 40-E comprises a sheet metal housing including a front wall 46, rear wall 48, and spaced side wall 50 and 52 that define a control passage 54. A bottom wall 56 is welded to the bottom edges of the controller and a mounting plate 58 is welded to the top edges of the walls to provided means for removeably securing the controller to inner wall 44 of gutter 20.

It should be mentioned that mounting plate 58 includes a plurality of spaced slots 60 that form inlets for the passage of water from the pool to control passage 54 and a plurality of mounting holes 62 for receiving threaded fasteners 63 that are screwed into aligned threaded holes 64 in gutter inner wall 44.

With continued reference to FIGS. 2 and 4, each of the gutter flow controllers 40–40-E includes a control passage outlet 70 that is normally covered by a hydrostatic gate indicated generally at 72. As seen in FIGS. 2 and 4, hydrostatic gate 72 is moveably mounted on rear wall 48 of the controller by means of threaded fasteners 74 provided at each end of gate 72. Each of the fasteners 74 extends freely through a respective compression spring 76 and hole 78, and then into threaded engagement with a respective threaded hole 80 provided in rear wall 48 of the controller.

It will be understood that hydrostatic gate 72, which includes an inner gate surface 82 and an outer gate surface 84, is biased towards a position wherein it throttles control passage outlet 70 by means of the spring forces exerted by springs 76. It will further be understood that the bias exerted by springs 76 on gate 72 can be established and increased and decreased in magnitude by adjusting threaded fasteners 74 inwardly and outwardly with respect to threaded holes 80.

In operation, the gutter flow controllers 40 through 40-E are as one of their functions adapted to establish and maintain flow gradients for a quiescent condition flow along the channel 86 of gutter system 20. Such quiescent condition flow is required to effect continuous circulation and hence filtering of the water as well as skimming action to remove particles of debris from the surface of the pool water.

As seen in FIG. 1, such quiescent condition flow is established in two different directions along two separate flow paths established along gutter channel 86. One flow path is directed in a clockwise direction from a gradient high point 90 to a gradient low point 92, as is indicated by arrows 94. The other flow path travels in a counter-clockwise direction between the same high point 90 and low point 92, as indicated by the arrows 96 along gutter channel 86 in FIG. 1.

The gradient of clockwise flow path 94 is established and controlled by the gutter flow controllers 40-A, 40-B and 40-C. This is accomplished at the outset of operation of the pool by adjusting the bias forces on the gates 72 of these three clockwise flow controllers, so as to pass individual quiescent condition flows, at their respective locations, of progressively decreasing volumetric flow rate, starting with the greatest flow volume passing through control passage 54 of controller 40A and ending with the least flow volume passing through the central passage 54 of controller 40-C.

It will be understood that the other flow path 96 is established in the same manner by adjusting flow controllers 40, 40-D and 40-E such that these controllers pass individual flows thru their control passages 54 of progressively decreasing volumetric flow rate, so as to produce progressively decreasing water depths in the gutter and hence a counter-clockwise flow gradient from high point 90 to low point 92.

With continued consideration of the operation of gutter flow controllers 40–40-E, these controllers not only function to establish and maintain the above described flow gradients, but also provide an additional and most important function of maintaining gutter capacity under dynamic surge conditions, such as occur, when a group of swimmers simultaneously enter the pool. When such surge conditions occur, water from the pool is caused to suddenly surge over an upper edge 98 of the inner gutter wall and immediately cause an increase in depth of the above described quiescent condition water flows existing in gutter channel 86.

The levels of such quiescent condition water flows are shown in FIG. 2 with the high water level along the gradient being indicated at 100 and the low water level along the gradient being indicated at 102.

Upon the occurance in a sudden increase in water depth, under surge conditions described above, the hydrostatic gates 72 of the flow controllers 40–40-E will be subjected to forces exerted on the outer surfaces 84 by the surge water entering the gutter. Such forces exerted on gates 72 are dynamic in nature, as a result of the dynamic impact of surge water falling into the gutter. The force exerted by the surge water is also static in nature once the gutter depth is increased to the level wherein the outer surfaces 84 of the gates are exposed to water at a water level greater than existed during the above described quiescent flow conditions.

It will now be understood that once the dynamic surge conditions occur, the force exerted on gates 84 will augment the bias forces exerted by springs 76 and thereby automatically throttle or terminate the flow from passage outlets 70 of flow controller 40 through 40-E.

We claim:

1. A gutter flow controller for a swimming pool of the type that includes a gutter extending around the perimeter of the pool and an inner gutter wall provided with wall openings at spaced intervals around said perimeter for delivering flows of water from the pool to the gutter, said gutter flow controller comprising, in combination, a controller frame extended through one of said wall openings and forming a control passage that extends downwardly from the wall opening to a control passage outlet in the lower regions of the gutter; and a hydrostatic gate moveably mounted on the controller frame in overlying relationship with said control passage outlet for controlling the flow through said outlet.

2. The gutter flow controller defined in claim 1 that includes bias means for constantly urging said gate towards said control passage outlet.

3. The gutter flow controller defined in claim 1 wherein said gate includes an outer gate surface exposed to force exerted by water in the gutter.

4. The gutter flow controller defined in claim 1 wherein said controller frame includes a mounting plate for removeably securing the controller to said inner gutter wall with said controller frame extended through said wall opening.

* * * * *